United States Patent [19]

Wiczer et al.

[11] Patent Number: 4,805,906

[45] Date of Patent: Feb. 21, 1989

[54] PINBALL MACHINE CONSTRUCTION

[75] Inventors: Max Wiczer, Skokie; Albin Peters, Crystal Lake, both of Ill.

[73] Assignee: Home Safe Corp., Niles, Ill.

[21] Appl. No.: 108,048

[22] Filed: Oct. 13, 1987

[51] Int. Cl.[4] ..... A63D 3/02; A63B 71/00; A47B 77/10; H01H 3/16

[52] U.S. Cl. ..... 273/119 A; 273/121 E; 273/129 V; 200/61.11; 312/282

[58] Field of Search ..... 273/121 A, 121 D, 121 E, 273/2, 3 R, 3 A, 8, 11 R, 118 A, 119 A, 124 A, 125 A; 312/109, 189, 328, 327, 300, 302, 282; 200/61.11

[56] References Cited

U.S. PATENT DOCUMENTS

| | | | |
|---|---|---|---|
| 2,310,163 | 2/1943 | Moxey | 273/118 A |
| 2,551,698 | 5/1951 | Pearl et al. | 273/121 A |
| 2,600,909 | 6/1952 | Nelson | 273/118 A |
| 3,180,646 | 4/1965 | Zale et al. | 200/61.11 |
| 3,578,802 | 5/1971 | Murphy et al. | 273/121 A |
| 3,826,883 | 7/1974 | Foster et al. | 200/61.11 |
| 4,375,286 | 3/1983 | Seitz et al. | 273/121 A |
| 4,397,509 | 8/1983 | Miller et al. | 273/148 B |
| 4,437,664 | 3/1984 | Wiczer et al. | 273/121 A |
| 4,440,457 | 4/1984 | Fogelman et al. | 273/DIG. 28 |
| 4,447,058 | 5/1984 | Tojza | 273/118 A |

FOREIGN PATENT DOCUMENTS

| | | | |
|---|---|---|---|
| 700591 | 12/1940 | Fed. Rep. of Germany | 273/121 E |
| 1427794 | 3/1976 | United Kingdom | 273/121 E |

*Primary Examiner*—Richard C. Pinkham
*Assistant Examiner*—Gary Jackson
*Attorney, Agent, or Firm*—Silverman, Cass, Singer & Winburn, Ltd.

[57] ABSTRACT

A pinball machine construction having a horizontally hinged security door which includes a top control panel which also clamps the glass cover over the playing field. A variable ball delivery system is remotely actuated and variable to deliver the balls to the playing field. Side wall flippers and half bumpers can be included which are mounted adjacent any wall on the playing field. The controls for the pinball machine can be mounted on top of the top control panel for easy access.

23 Claims, 4 Drawing Sheets

FIG. 3

FIG. 1
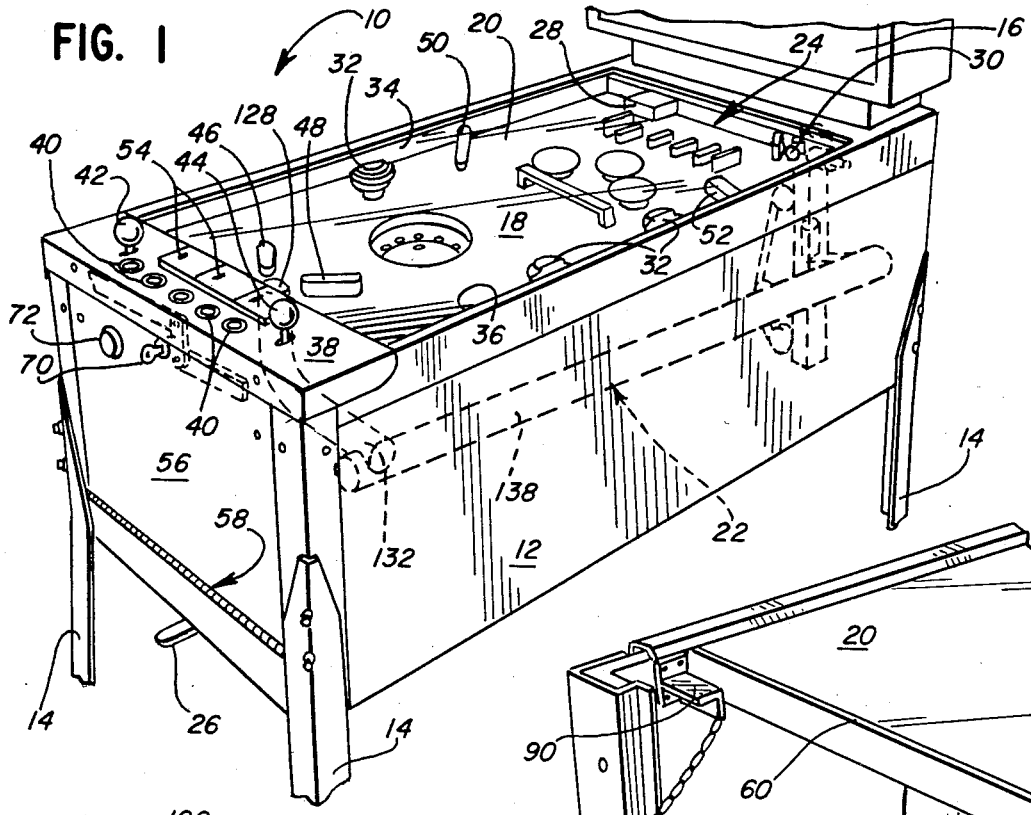
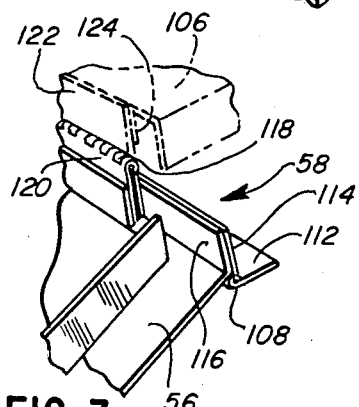
FIG. 3
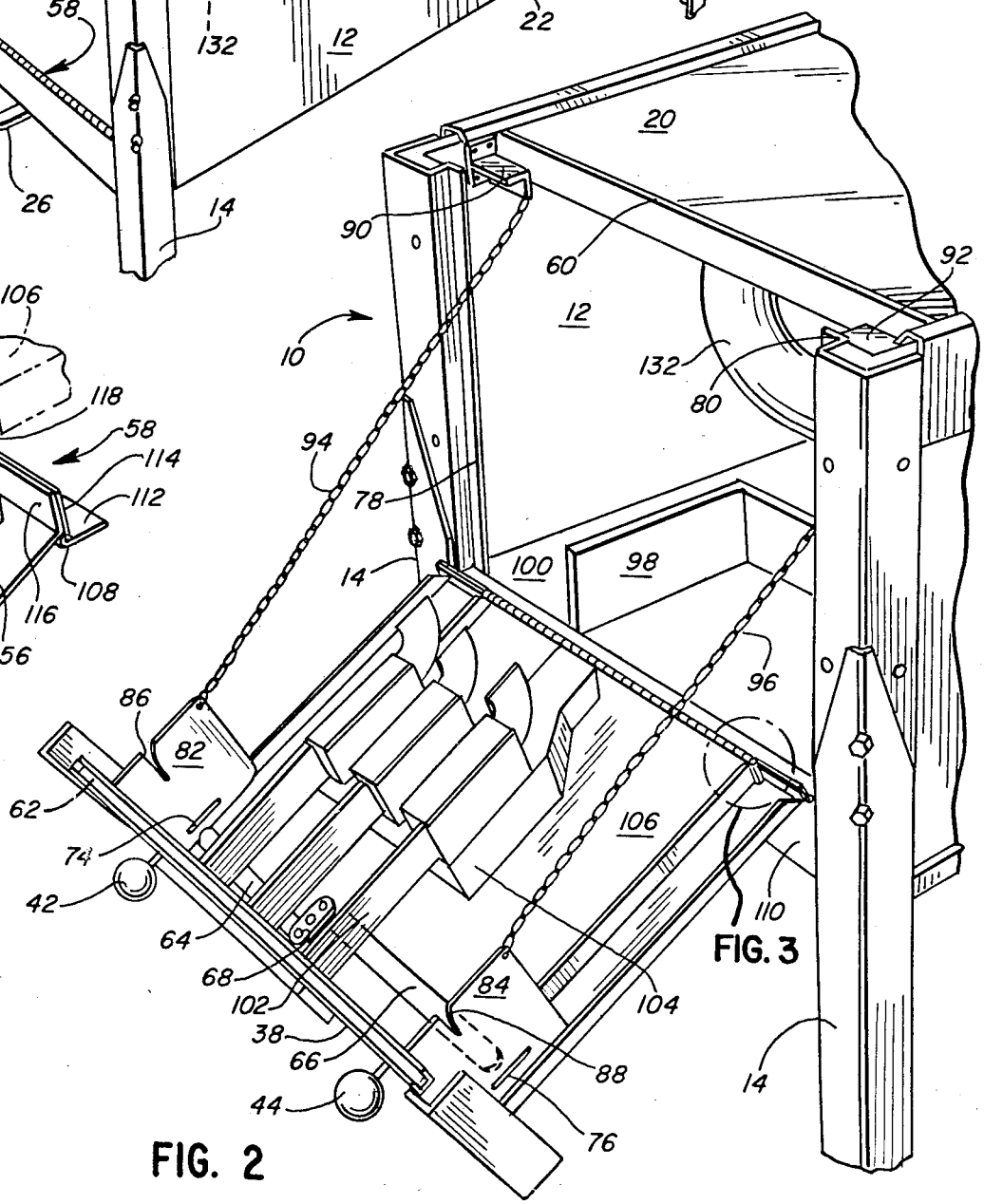
FIG. 3
FIG. 2

FIG. 4
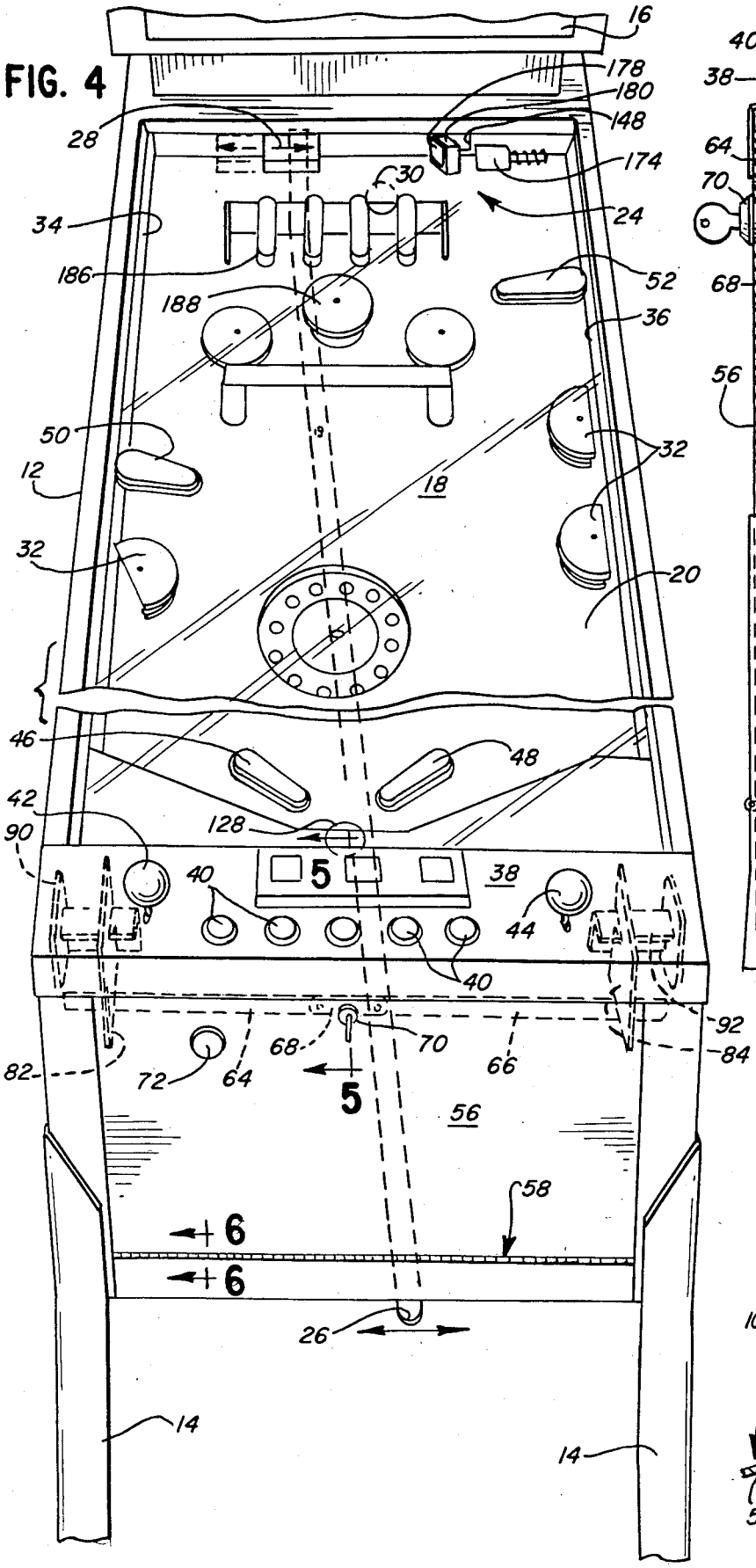
FIG. 5
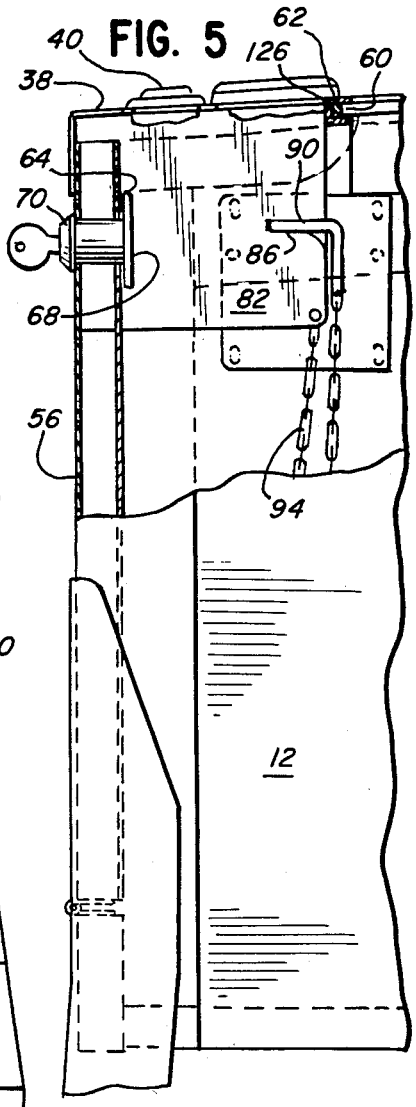
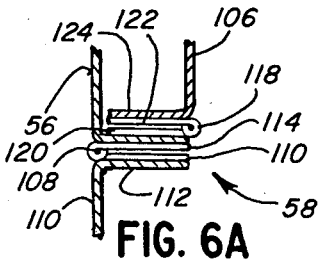
FIG. 6A
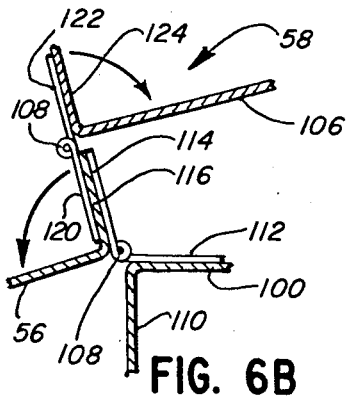
FIG. 6B

FIG. 8
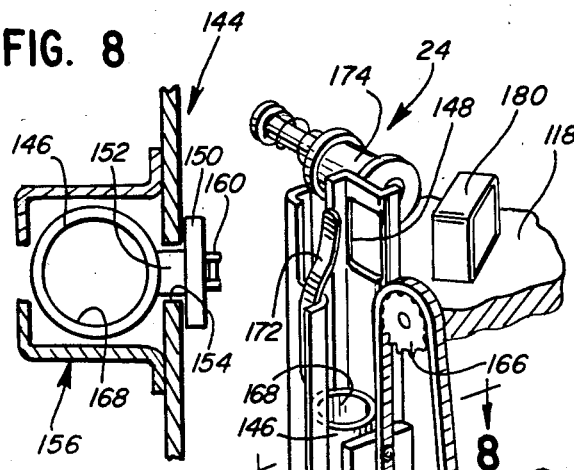
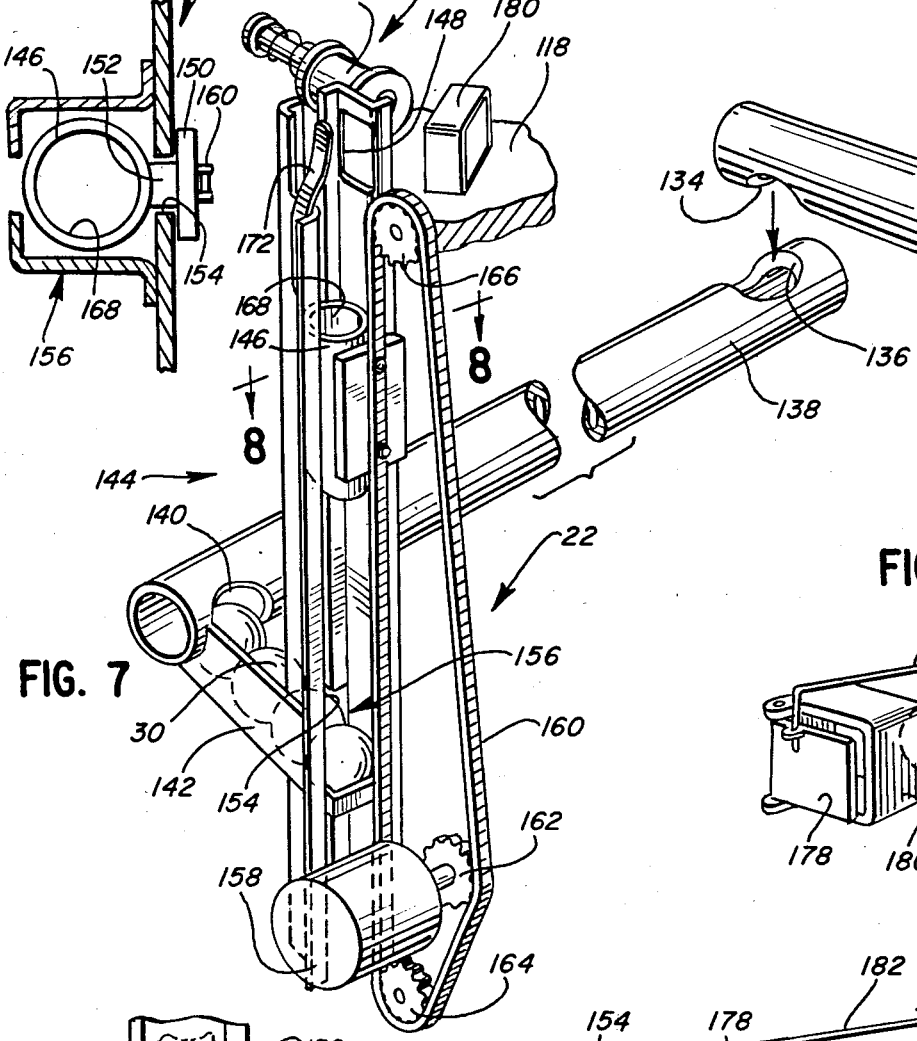
FIG. 7
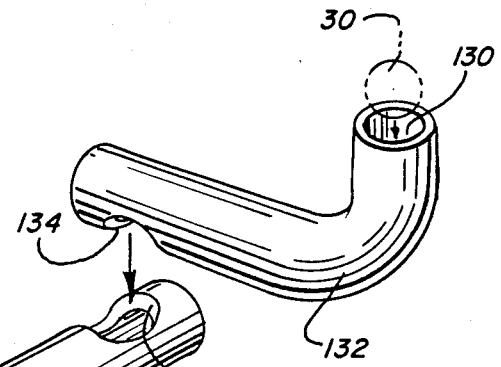
FIG. 10A
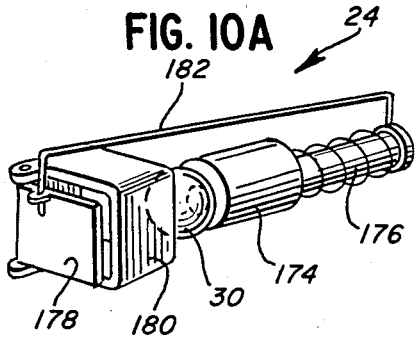
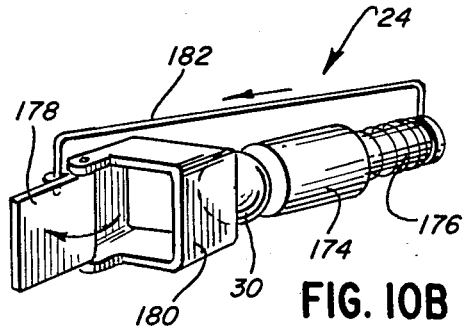
FIG. 10B
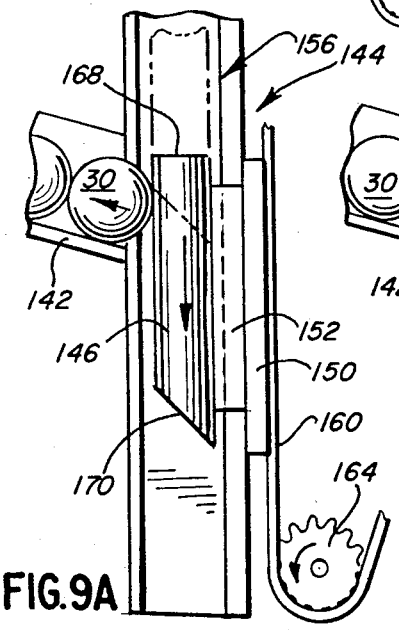
FIG.9A
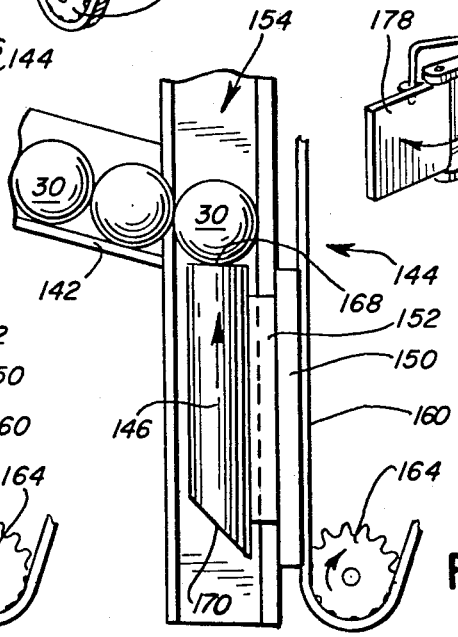
FIG. 9B FIG. 11
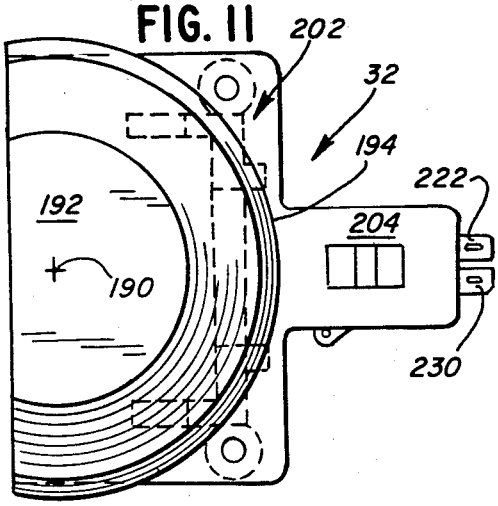
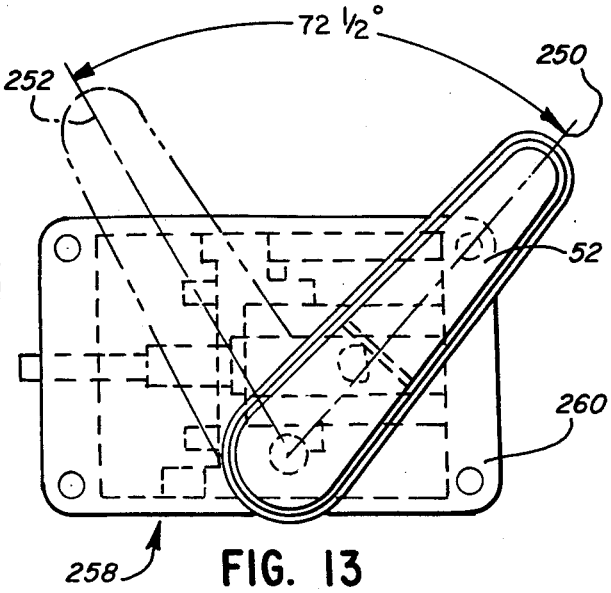
FIG. 13
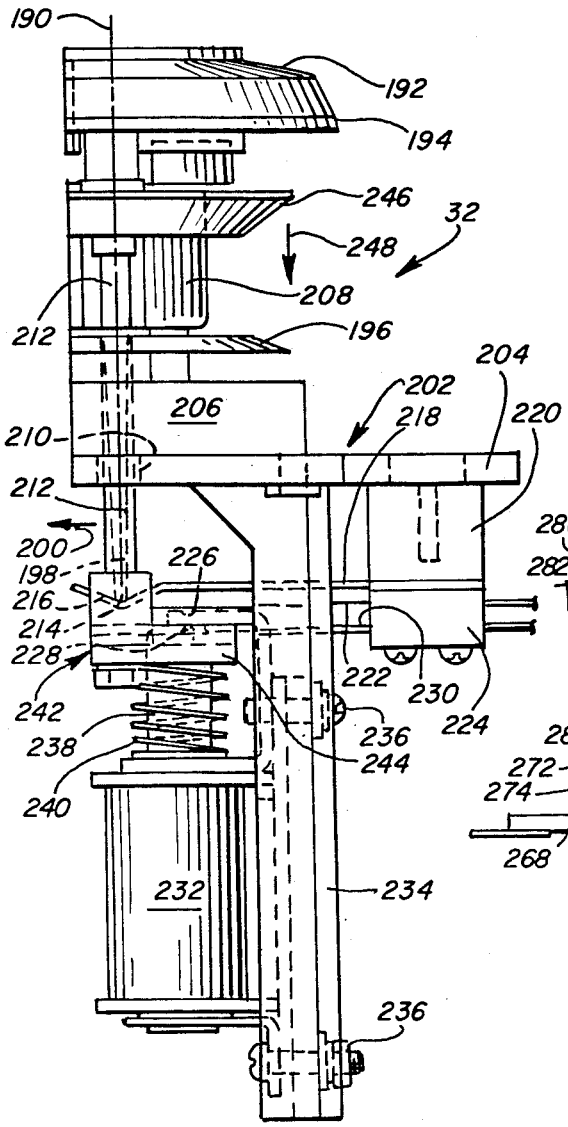
FIG. 12
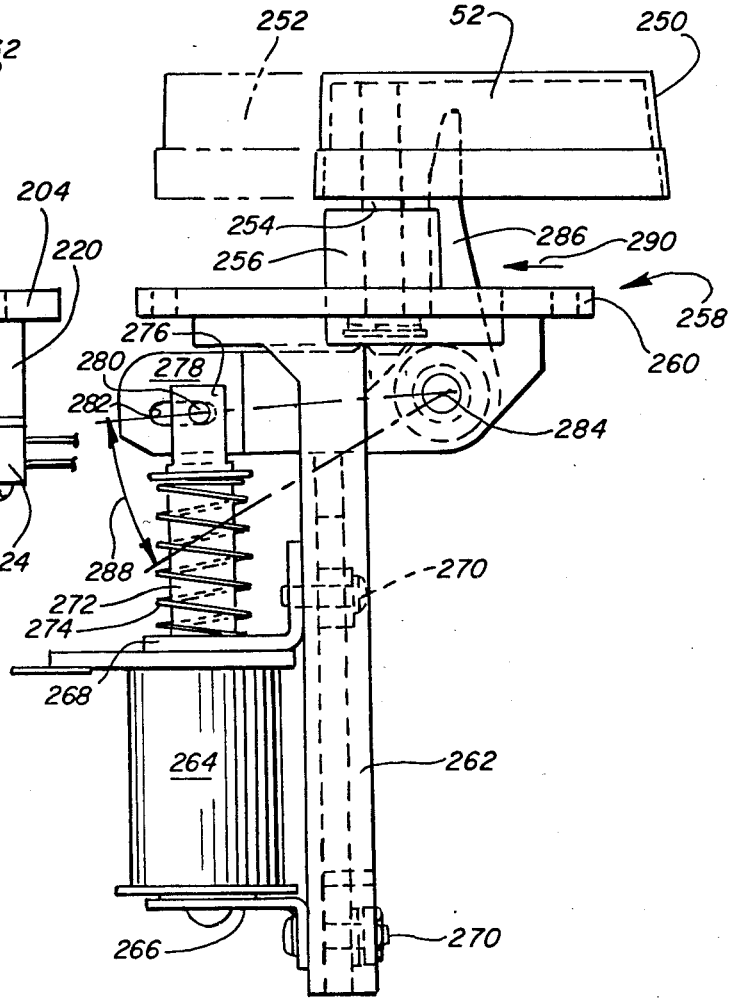
FIG. 14

PINBALL MACHINE CONSTRUCTION

BACKGROUND OF THE INVENTION

This invention relates generally to a pinball game of a type wherein a ball rolls along an inclined playing field board for interaction with targets or the like and more particularly to a pinball machine construction allowing a player to have significant control of the game.

Pinball machines have been losing popularity for several reasons, such as competition with video games which provide more player interaction and excitement. Pinball machines are inherently Of fixed design, once built. A player with diligence can learn to maximize his score on such fixed design machines, after which the challenge offered by playing such a machine is greatly reduced. Further, such machines can be looked at as playing the player, because the player does not have sufficient control to really play the machine. Adding control to the player would increase the player's interaction and the challenge of the machine would not diminish resulting in more enjoyment. Further, the machine owner also will benefit from the extended utilization of such machines.

In most standard pinball machines, the ball is introduced into play by means of a manually retractable, spring-biased shooter pin which propels the ball along a guide track onto the field of play. Although the spring biasing provides some flexibility in introducing the ball into play, the spring wears quickly and provides operational difficulty for young players or those with reduced arm strength or dexterity.

The flipper controls of prior pinball machines generally are mounted on the opposite sides of the machine cabinet. Again, young and other short players cannot easily manipulate both controls at the same time, as generally required. Further, generally only the two side controls are provided, again reducing the player's control of the pinball game.

Further, the pinball machines generally are coin operated and include some electrical and/or electronic circuitry and controls. Access to the circuitry and the coins collected generally is by operation of a conventional locking front door which is vertically hingedly mounted on the front of the pinball machine. This door provides an inherent problem since players can strike the door, bending the door in an attempt to gain access to the machine or merely in frustration over the operation or non-operation of the machine. The doors generally include a single lock mechanism on one side of the door. Striking the door can breach the door or the single locking bar and likewise can damage the electronics generally mounted on the inside of the door.

The playing field also generally is supplied with flippers and circular bumpers, both of which have to be mounted away from the side walls of the playing field. The size of the playing field also is reduced by the ball guide track, generally along one side thereof.

It thus would be desirable to provide a pinball machine construction, which provides for maximum machine security, enlarged size of playing field and enhanced player interaction with the pinball game, including an improved variable ball delivery system with easily accessible and flexible controls.

SUMMARY OF THE INVENTION

The above and other disadvantages of prior art pinball machines are overcome in accordance with the present invention by providing a horizontally hingedly mounted security door which has the operative controls mounted on the upper or top end thereof. The door locks securely into the machine and clamps the glass covering the playing field in one edge thereof.

A variable ball delivery system is provided which is remotely variable and eliminates the spring-biased prior art ball pin and guide track. The playing field is enlarged by the removal of the ball guide track and can include side mounted flippers which are operable in either direction. The sides or other wall surfaces of the playing field also can include half bumpers. The top easily accessible controls can include flipper buttons as well as joy stick mechanisms for flexibility of operation and player interaction.

BRIEF DESCRIPTION OF THE DRAWINGS

FIG. 1 is a partial perspective view of one embodiment of the pinball machine construction of the invention;

FIG. 2 is an enlarged perspective view of one embodiment of the security door of the machine of FIG. 1;

FIG. 3 is a partial perspective view of the mounting of the door and mechanisms of FIG. 2;

FIG. 4 is a top partial perspective view of the machine of FIG. 1;

FIG. 5 is a partial side sectional view of the machine of FIG. 4 taken along the line 5—5 therein;

FIG. 6A is a second partial side sectional view of the machine of FIG. 4 taken along the line 6—6 therein;

FIG. 6B is a second operative position of the machine section of FIG. 6A;

FIG. 7 is a partial perspective view of the ball delivery system of the invention;

FIG. 8 is a cross-section of the system of FIG. 7 taken along the line 8—8 therein:

FIGS. 9A and 9B are two partial side plan views of the system of FIG. 7 illustrating the operation thereof;

FIGS. 10A and 10B are two perspective views of the ball delivery or shooter mechanism of the system of FIG. 7;

FIGS. 11 and 12, respectively, are a top and a side plan view of a half bumper of the invention; and FIGS. 13 and 14, respectively, are a top and a side plan view of a side flipper of the invention.

DESCRIPTION OF THE PREFERRED EMBODIMENTS

Referring to FIG. 1, one embodiment of the pinball machine of the invention is designated generally by the reference numeral 10. The machine 10 includes a well known conventional body or cabinet 12 mounted on legs 14. The scores by a player are displayed on a conventional scoreboard 16. The machine 10 includes a playing field or board 18, covered by a glass cover 20.

The machine 10 includes a ball delivery system 22, best described with respect to FIGS. 7–10B. An adjustable ball delivery mechanism or shooter 24 includes a lever 26 or other mechanism which adjusts a ball bumper 28. The adjustable bumper 28 determines the entry trajectory of a ball 30 onto the field 18, as best described with respect to FIGS. 4, 10A and 10B. The field can include one or more half bumpers 32, which can be mounted adjacent any wall of the playing field 18, such as side walls 34 and 36.

A top control panel 38 includes a plurality of buttons 40 and a pair of joy stick mechanisms 42 and 44. The joy sticks 42 and 44 and the buttons 40 can be utilized to control a conventional pair of flippers 46 and 48, the ball delivery system 22 and a pair of side wall flippers 50 and 52 of the invention. The control panel 38 also includes one or more coin slots 54 to operate the pinball game in a conventional manner.

The control panel 38 is formed as a top wall for a security door 56, best illustrated in FIGS. 2–6A. The door 56 includes an internal double hinge mechanism 58 which permits the door 56 to pivot on a horizontal axis formed by the hinge 58 to permit access to the inside of the machine 10. The glass cover 20 includes an edge 60 which is gripped by a U-shaped slot or channel member 62 when the door 56 is closed.

The door 56 is securely locked by a pair of lock bars 64 and 66 pivotally mounted on a rotating locking bracket 68. The bracket 68 and the bars 64 and 66 can be locked in their outwardly extended and locked position (FIGS. 1, 4 and 5) by a conventional lock and key mechanism 70. The door 56 can include a conventional replay button 72, which also could be mounted in the panel 38 if desired. The bars 64 and 66 preferably extend through a pair of slots 74 and 76 to engage behind or into a pair of side wall brackets 78 and 80.

The slots 74 and 76 are formed, respectively, in a pair of locking brackets 82 and 84. The brackets 82 and 84 include a pair of guide clamping slots 86 and 88. The guide slots 86 and 88 matingly engage a respective pair of locking brackets 90 and 92, which are mounted on the cabinet 12. The door 56 can be connected to the brackets 90 and 92 by a respective pair of chains or cables 94 and 96 engaged at one end to the brackets 90 and 92 and at the opposite ends to the brackets 82 and 84. The double bars 64 and 66 the slots 74 and 76 and the brackets 82 and 84 prevent a breach of the door 56.

A coin box retaining bracket 98 is formed on a floor 100 of the body 12. A conventional coin box (not illustrated) would be inserted into the bracket 98 to receive coins placed into the slots 54. The slots 54 register with respective coin chutes 102. In contrast to prior machines, the chutes do not provide an S-shaped or slanted path into respective coin counting mechanisms 104, but instead are aligned to drop straight into the mechanisms. This straight drop alignment facilitates cleaning of the chutes 102 and helps prevent the jamming of the chutes 102 and the counters 104.

The coin counters 104 are mounted onto a wall 106 which is hingedly secured to the door 56 by the hinge mechanism 58 (FIGS. 3, 6A and 6B). The hinge mechanism 58 includes a first hinge member 108 which is secured between a front wall 110 and the floor 100 of the cabinet 12. The hinge member 108 includes a first hinge plate 112, which is secured to the floor 100. The hinge member 108 includes a second hinge plate 114, which is secured to an upstanding flange 116 of the door 56, such as by welding thereto.

The wall 106 is connected to the hinge member 108 by a second hinge member 118. The hinge member 118 includes a first hinge plate 120, also secured to the flange 116 A second hinge plate 122 of the member 118 is secured to an upstanding flange 124 of the wall 106.

In normal operation (FIGS. 2, 4, 5 and 6A), the wall 106 and the door 56 are secured together by a pin or other latching mechanism, not illustrated. However, to service the coin counter 104 the wall 106 is released and pivoted away from the door 56 (FIGS. 3 and 6B).

The slot or channel member 62, preferably includes a cushion 126 therein. As illustrated in FIG. 5, as the door 56 is closed, the slot 86 engages the bracket 90 and the top wall of the door 56 with the channel 62 engages the edge 60 of the glass 20. The channel 62 bears against the edge 60 and moves in a slight radius, due to the hinge 58, to securely clamp the glass into the bracket 62 and dow against a bearing surface (not illustrated).

The resultant security door 56 has a double security bar 64 and 66 securely engaged with the cabinet 12 and prevented from being breached by the bracket slots 74 and 76. Although illustrated with the controls on top of the panel 38, the door 56 can be utilized with conventional machines having a conventional shooter mechanism mounted in the front of the machine.

Referring now to FIGS. 7–9B, the ball delivery system 22 is best illustrated. The balls 30 enter the system 22 from the playing field 18 via an opening 128 between the flippers 46 and 48. The opening 128 is aligned with an opening 130 in the end of a ball return tube 132. The tube 132 has a second opening 134, which mates with an opening 136 in a second tube 138. The tubes 132 and 138 are mounted to the cabinet 12 to form an inclined gravity feed path for the balls 30 to a second opening 140 in the tube 138. Any type of return feed path can be utilized, such as a pair of guide rails or a channel, preferably gravity fed.

The ball or balls 30 are discharged from the opening 140 onto a feed chute or ramp 142 which is inclined and joined to an elevator 144. The elevator 144 includes a lift 146 which moves from a lower ball loading position (FIG. 9B) to an upper ball delivery position to deliver the ball 30 through an opening 148 to the ball delivery or shooter mechanism 24.

The lift 146 is mounted onto a lift plate 150 by an arm 152. The arm 152 extends through a slot 154 formed in an elevator shaft or enclosure 156. The lift plate 150 is driven up and down the shaft 156 by a reversible drive motor 158, which drives a drive chain or cord 160, such as by a drive gear 162. The chain 160 is mounted or rotation about the drive gear 162 and a pair of idler gears 164 and 166.

The lift 146 includes a pocket or seat 168 at its upper end into which the balls 30 are seated. As the lift 146 is returned to the loading position, FIG. 9A, the balls 30 first are moved back up the chute or ramp 142 by a beveled end piece 170 on the lift 146. Once the lift 146 is in the loading position, FIG. 9B, one of the balls 30 feeds onto the seat 168. When the elevator 144 is activated, automatically or by operation of one of the buttons 40, the lift 146 carries the ball 30 to the opening 148 where it is positively ejected through the opening 148 by an ejection spring 172. The delivery opening 148 can include a spring biased door (not illustrated), so that the ball 30 cannot be accidentally lost back into the elevator shaft 156. The elevator positions can be controlled by conventional microswitches (not illustrated) mounted adjacent the upper and lower positions to stop and reverse the elevator movement, as desired.

The ball 30 is retained in the delivery mechanism 24, until one of the buttons 40 is activated to deliver the ball to the playing field 18. The ball 30 can be retained in a depression or well (not illustrated) until delivery is desired. When the delivery button 40 is activated, a solenoid 174 is activated. The solenoid 174 is biased by a spring 176 or other mechanism to a first inactive position (FIG. 1OA). When the solenoid 174 is activated, it drives the ball 30 through a door 178 of a door housing 180. The door 178 can be spring biased (not illustrated), but preferably is positively actuated by a drive rod 182 coupled to the solenoid 174.

The actuation of the solenoid 174 drives the rod 182 to open the door 178 (FIG. 10B) to thus deliver the ball onto the field 18 by the solenoid piston (not illustrated). The solenoid 14 drives the ball 30 against the ball delivery bumper 28 from where it rebounds onto the playing field 18. The position of the bumper 28 is adjustable by moving the lever 26 (FIG. 4) which is coupled via a pivot 184 to move the bumper 28 into the desired position. The ball 30 then is active on the playing field 18, where it can be acted upon by a number of conventional mechanisms, such as gates 186, round bumpers 188, the side walls 34 and 36 and the flippers 46 and 48. The ball 30 also can be acted upon by the novel mechanisms of the invention, the half bumpers 32 and the side wall flippers 50 and 52.

The bumper 28 also can be adjusted electromechanically if desired. The bumper 28 can be motorized similar to the elevator 144 and its movement can be controlled by a stop and start button (one of the buttons 40) or by one of the joy sticks 42 and 44. The position of the bumper 28 can be controlled again by using conventional microswitches mounted along the movement path or by utilizing a controlled drive stepping motor.

Although only one ball delivery system 24 has been illustrated, more could be provided if desired. Further, the ball delivery location now can be located any place desired on the playing field 18, since the location no longer is limited by the mechanical shooter pin and ball chute previously utilized. For the same size cabinet 12 (generally standardized), the playing field 18 thus is enlarged because the ball chute (normally adjacent the wall S6) has been eliminated.

Referring now to FIGS. 11 and 12, one of the half bumpers 32 is best illustrated. A conventional bumper, such as the bumper 188, is formed in a complete circle configuration and therefore generally is positioned in the central areas of the playing field 18. If the conventional circular bumper is placed adjacent a wall or other structure, a great deal of playing space is lost and also a large portion of the active surface of the bumper is wasted because the ball is blocked by the wall from striking that portion of the bumper.

The half bumper 32 actually has a configuration slightly greater than half of a circle since the bumper parts extend beyond a center axis 190. The bumper 32 includes a cap 192, generally formed of plastic which has a perimeter 194 formed slightly greater than one-half of a circle. The cap 192 preferably is translucent and includes a lamp (not illustrated) which can be activated when the ball 30 strikes a wafer or actuator 196. When the ball 30 strikes the wafer or actuator 196 it is tilted, which moves an actuator rod 198 in a direction indicated by an arrow 200. The rod 198 is coupled or mounted to the wafer 196 and can be formed of plastic integrally therewith.

The cap 192 is mounted on a standard 202, which has separately mounted or integrally formed therewith a mounting plate 204. The plate 204 includes an arcuate upstanding wall 206, which includes a center post 208 upon which the cap 192 is mounted. The rod 198 passes through an aperture (not illustrated) in the plate 204. The plate 204 also includes a pair of apertures or passageways, one of which 210 is illustrated. A pair of actuator posts, one of which 212 is illustrated, pass freely through the passageways 210.

When the rod 198 moves in the direction of the arrow 200, a free end of the rod 214 bears against a pocket 216 formed in a spring bar 218. The spring bar 218 is mounted onto an extension 220 mounted to or formed with the plate 204. The spring bar 218 bears against one leaf spring 222 of a relay 224 also mounted on the extension 220.

The leaf 222 carries a contact 226. The contact 226 will mate with a contact 228 carried by a second leaf spring 230 of the relay 224, when the spring bar 218 pushes, is forced downwardly by the rod 198.

The mating of the contacts 226 and 228 of the relay 224 causes a solenoid 232 to energize. The solenoid 232 is mounted on a second depending arm or extension 234 of the standard 202. The solenoid 232 is mounted to the standard by any conventional fastening means, such as a plurality of bolts 236. The solenoid 232 includes a plunger or rod 238 normally biased in the position shown in FIG. 12 by a compression spring 240.

An actuator drive assembly 242 is mounted onto the rod 238. The pair of actuator rods 212 are mounted at the lower ends onto a plate 244 affixed to the rod 238 and have an arcuate ball striker ring 246 mounted to the upper ends of the rods 212. When the ball 30 contacts the wafer 196, the solenoid 232 is actuated withdrawing the plunger rod 238 against the spring 240 in a sharp, rapid movement illustrated by an arrow 248. As indicated by the arrow 248, the ring 246 is depressed quickly in the downward direction, striking or kicking the ball 30 away from the bumper 32.

One of the side flippers 52 is best illustrated in FIGS. 13 and 14. The flipper 52 is actuated to move between a first position 250 illustrated in FIG. 13 and a second position 252 illustrated in phantom, or vice versa. The flipper 52 is rotatingly mounted on a pin 254 pivotally mounted in an extension 256 of a standard 258. The standard 258 includes a mounting plate 260 affixed to or integrally formed therewith. The standard 258 also includes a depending arm or extension 262 onto which a solenoid 264 is mounted, such as by a pair of brackets 266 and 268 fastened to the extension 262 by any convenient fastening means, such as a plurality of bolts 270.

A conventional flipper assembly includes the solenoid mounted along the plate 260 substantially parallel to the flipper 250. In the FIG. 13 view, the solenoid and structure would extend to the bottom, i.e. downwardly. This presents at least two problems in that the mechanism extending away from the flipper prevents the flipper from being mounted adjacent the side or other walls of the playing field 18 Further, the mechanism wears easily and causes maintenance problems.

The vertical mounting of the flipper 52 allows the flipper 52 to be mounted close to the side or other walls and additionally the design deters the wearing of the mechanism. The solenoid 264 includes a drive rod or plunger 272 biased into the rest position illustrated in FIG. 14 by a compression spring 274.

An upper end 276 of the plunger 272 can be slotted to accommodate an actuating arm 278 to be pivotally mounted thereto with a pivot pin or bolt 280. The bolt 280 passes through a slot 282 formed in the arm 278. The arm 278 is pivotally mounted to the standard 258 by a pivot pin 284. The arm 278 includes an actuator lever 286, which is inserted into an opening or slot (not illustrated) formed in the flipper 286.

The solenoid 264 when actuated by one of the buttons 40 or the joy sticks 42 and 44, retracts the rod 272 pulling the arm 278 downwardly in an arc 288. This moves the lever 286 in the direction of an arrow 290 which moves the flipper 52 to the second position 252.

Modification and variations of the present invention are possible in light of the above teachings. It is therefore to be understood that within the scope of the appended claims, the invention may be practiced otherwise than as specifically described.

What is claimed and desired to be secured by Letters Patent of the United States is:

1. An improved pinball machine construction, comprising:

a horizontal hinged security door mounted in a front wall of the pinball machine and having a top control panel having at least one control actuator mounted thereon, said top control panel overlying a portion of the top of said pinball machine and securely clamping a glass cover panel into said machine when said door is closed, said door including a double hinge mechanism with first hinge means securing the door to said machine and second hinge means securing an accessory panel hingedly to said door.

2. The construction as defined in claim 1, wherein said control panel includes a plurality of control actuators mounted thereon, at least one of said actuators including a joy stick mechanism.

3. The construction as defined in claim 1, wherein said control panel includes a U-slot locking member which engages and clamps said glass cover panel when said door is closed.

4. The construction as defined in claim 1, wherein said machine includes a pair of internal locking brackets mounted on opposite sides of the machine cabinet which mate with a respective pair of slots formed in locking brackets formed on opposite sides of said door.

5. The construction as defined in claim 4, wherein said door includes a double bar locking mechanism which includes a pair of lock bars which are extended through said door locking brackets to be secured by said cabinet when said door is closed and said bar locking mechanism is locked.

6. The construction as defined in claim 1, wherein said accessory panel includes at least one coin collecting mechanism mounted thereto.

7. The construction as defined in claim 6, wherein said coin mechanism is aligned for a straight coin drop from at least one coin slot in said control panel when said door is closed.

8. The construction as defined in claim 1, further including a ball playing field and means for variably delivering a ball to said playing field.

9. The construction as defined in claim 9, wherein said delivery means include ball return means for returning said ball from said playing field to elevator means for moving said ball to a ball delivery position.

10. The construction as defined in claim 9, including electromechanical shooter means for delivering said ball from said delivery position to said playing field by actuation of said control actuator.

11. The construction as defined in claim 10, including door assembly means for retaining said ball in said delivery position until actuation of said control actuator.

12. The construction as defined in claim 12, including means for opening a door of said door assembly means when said electromechanical shooter means delivers said ball to said playing field.

13. The construction as defined in claim 10, including means for remotely adjusting a ball bumper to vary the delivery of said ball to said playing field.

14. The construction as defined in claim 1, including half bumper means for striking said ball, said bumper means being mounted adjacent a wall of said machine.

15. The construction as defined in claim 14, wherein said bumper means include a half bumper body having a substantially circular configuration, with about half of said configuration eliminated allowing said bumper body to be mounted adjacent said wall.

16. The construction as defined in claim 15, including an actuating wafer and a ball striking ring, said wafer including means for actuating said ring when said wafer is contacted by a ball for causing said ring to strike said ball and move it away from said bumper body.

17. The construction as defined in claim 16, including electromechanical means for moving said striking ring and said wafer actuating means including a rod which moves upon contact with said wafer by said ball to activate said electromechanical means.

18. The construction as defined in claim 1, including side wall flipper means for striking said ball, said flipper means including a construction allowing mounting adjacent a wall of said machine.

19. The construction as defined in claim 18, wherein said flipper means include vertically actuated electromechanical means for moving said flipper means.

20. The construction as defined in claim 18, wherein said flipper means include a horizontally pivoting flipper mounted on a standard and vertically mounted electromechanical means having vertically movable drive means for pivoting said flipper, said flipper and said standard configured to allow said flipper to be mounted adjacent a wall on said playing field.

21. The construction as claimed in claim 20, wherein said drive means include a vertically movable rod pivotably coupled to an actuator arm at one end thereof, said actuator arm pivotally mounted on said standard and having an actuating lever engaging said flipper to pivot said flipper.

22. An improved pinball machine construction, comprising:

a horizontal hinged security door mounted in a front wall of the pinball machine and having a top control panel having at least one control actuator mounted thereon, said top control panel overlying a portion of the top of said pinball machine and securely clamping a glass cover panel into said machine when said door is closed, said machine including a pair of internal locking brackets mounted on opposite sides of the machine cabinet which mate with a respective pair of slots formed in locking brackets formed on opposite sides of said door, said door a double hinge mechanism with first hinge means securing the door to said machine and second hinge means securing an accessory panel hingedly to said door.

23. The construction as claimed in claim 22 including a ball playing field and means for variably delivering a ball to said playing field.

* * * * *

UNITED STATES PATENT AND TRADEMARK OFFICE

CERTIFICATE OF CORRECTION

PATENT NO. : 4,805,906

DATED : February 21, 1989

INVENTOR(S) : Max Wiczer and Albin Peters

It is certified that error appears in the above-identified patent and that said Letters Patent is hereby corrected as shown below:

Column 1, line 13, "Of" should be --of--;

Column 5, line 35, "S6" should be --36--;

Column 7, line 52, "claim 9" should be --claim 8--;

Column 7, line 63, "claim 12" should be --claim 11--.

Signed and Sealed this

Fifteenth Day of August, 1989

*Attest:*

DONALD J. QUIGG

*Attesting Officer*

*Commissioner of Patents and Trademarks*